US009082396B2

(12) United States Patent
Faller et al.

(10) Patent No.: US 9,082,396 B2
(45) Date of Patent: Jul. 14, 2015

(54) AUDIO SIGNAL SYNTHESIZER

(71) Applicant: Huawei Technologies Co., Ltd., Shenzhen (CN)

(72) Inventors: Christof Faller, Shenzhen (CN); David Virette, Munich (DE); Yue Lang, Munich (DE); Jianfeng Xu, Munich (DE)

(73) Assignee: Huawei Technologies Co., Ltd., Shenzhen (CN)

( * ) Notice: Subject to any disclaimer, the term of this patent is extended or adjusted under 35 U.S.C. 154(b) by 295 days.

(21) Appl. No.: 13/744,690

(22) Filed: Jan. 18, 2013

(65) Prior Publication Data

US 2013/0129096 A1 May 23, 2013

Related U.S. Application Data

(63) Continuation of application No. PCT/CN2010/075308, filed on Jul. 20, 2010.

(51) Int. Cl.
*G10L 19/008* (2013.01)

(52) U.S. Cl.
CPC ..... *G10L 19/008* (2013.01)

(58) Field of Classification Search
CPC ..... H04S 5/00; H04S 3/00; H04S 1/00; H04S 5/005; H04S 5/02; H04S 2420/00; H04S 2420/07; G10L 19/008; G10L 19/02
USPC ..... 381/17–23, 63, 98
See application file for complete search history.

(56) References Cited

U.S. PATENT DOCUMENTS 7,391,870 B2 * 6/2008 Herre et al. ..... 381/23
7,564,978 B2 * 7/2009 Engdegard et al. ..... 381/23

(Continued)

FOREIGN PATENT DOCUMENTS

CN 1781338 A 5/2006
CN 101425292 A 5/2009

(Continued)

OTHER PUBLICATIONS

Faller, et al., "Efficient Representation of Spatial Audio Using Perceptual Parametrization," IEEE Workshop on the Applications of Signal Processing to Audio and Acoustics, New Paltz, New York, Oct. 2001, 4 pages.

(Continued)

*Primary Examiner* — Vivian Chin
*Assistant Examiner* — Jason R Kurr
(74) *Attorney, Agent, or Firm* — Conley Rose, P.C.; Grant Rodolph; William H. Dietrich

(57) ABSTRACT

The invention relates to an audio signal synthesizer, the audio signal synthesizer comprises a transformer for transforming the down-mix audio signal into frequency domain to obtain a transformed audio signal; a signal generator for generating a first auxiliary signal, for generating a second auxiliary signal, and for generating a third auxiliary signal upon the basis of the transformed audio signal; a de-correlator for generating a first de-correlated signal, and for generating a second de-correlated signal from the third auxiliary signal, the first de-correlated signal and the second de-correlated signal being at least partly de-correlated; and a combiner for combining the first auxiliary signal with the first de-correlated signal to obtain a first audio signal, and for combining the second auxiliary signal with the second de-correlated signal to obtain the second audio signal, the first audio signal and the second audio signal forming the multi-channel audio signal.

25 Claims, 3 Drawing Sheets

(56) References Cited

U.S. PATENT DOCUMENTS

| | | | | |
|---|---|---|---|---|
| 7,668,722 | B2 * | 2/2010 | Villemoes et al. | 704/500 |
| 2006/0009225 | A1 | 1/2006 | Herre et al. | |
| 2006/0053018 | A1 | 3/2006 | Engdegard et al. | |
| 2006/0140412 | A1 | 6/2006 | Villemoes et al. | |
| 2006/0239473 | A1 | 10/2006 | Kjorling et al. | |
| 2007/0121952 | A1 | 5/2007 | Engdegard et al. | |
| 2007/0258607 | A1 | 11/2007 | Purnhagen et al. | |
| 2008/0118073 | A1 | 5/2008 | Tsutsui et al. | |
| 2008/0205657 | A1 | 8/2008 | Oh et al. | |
| 2009/0240503 | A1 | 9/2009 | Miyasaka et al. | |
| 2009/0262949 | A1 | 10/2009 | Takagi et al. | |

FOREIGN PATENT DOCUMENTS

| | | | |
|---|---|---|---|
| JP | 2006524832 | A | 11/2006 |
| JP | 2008505368 | A | 2/2008 |
| JP | 2008517338 | A | 5/2008 |
| JP | 2008536183 | A | 9/2008 |
| JP | 2010511908 | A | 4/2010 |
| JP | 2012505429 | A | 3/2012 |
| WO | 2007029412 | A1 | 3/2007 |
| WO | 2007043388 | A1 | 4/2007 |
| WO | 2010042024 | A1 | 4/2010 |

OTHER PUBLICATIONS

Faller, et al., "Binaural Cue Coding: A Novel and Efficient Representation of Spatial Audio," IEEE International Conference on Acoustics, Speech, and Signal Processing, Orlando, Florida, May 2002, 4 pages.

Schuijers, et al., "Advances in Parametric Coding for High-Quality Audio," Audio Engineering Society, Convention Paper 5852, 114th Convention, Amsterdam, The Netherlands, Mar. 2003, 11 pages.

Baumgarte, et al., "Binaural Cue Coding—Part I: Psychoacoustic Fundamentals and Design Principles," IEEE Transactions on Speech and Audio Processing, vol. 11, Issue 6, Nov. 2003, 11 pages.

Faller, et al., "Binaural Cue Coding—Part II: Schemes and Applications," IEEE Transactions on Speech and Audio Processing, vol. 11, Issue 6, Nov. 2003, 12 pages.

Faller, et al., "Binaural Cue Coding Applied to Stereo and Multi-Channel Audio Compression," Audio Engineering Society, Convention Paper 5574, 112th Convention, Munich, Germany, May 2002, 9 pages.

Blauert, "Spatial Hearing-Revised Edition: The Psychophysics of Human Sound Localization," the MIT Press, Oct. 1996, 3 pages.

Faller, "Parametric Multichannel Audio Coding: Synthesis of Coherence Cues," IEEE Transactions on Audio, Speech, and Language Processing, vol. 14, Issue 1, Jan. 2006, 12 pages.

Faller, "Multiple-Loudspeaker Playback of Stereo Signals," J. Audio Eng. Soc., vol. 54, Issue 11, Nov. 2006, 15 pages.

Haykin, "Adaptive Filter Theory (4th Edition)," Prentice Hall, Sep. 2001, 938 pages.

Herre, et al., "MPEG Surround—The ISO/MPEG Standard for Efficient and Compatible Multichannel Audio Coding," J. Audio Eng. Soc., vol. 56, Issue 11, Nov. 2008, 24 pages.

Hotho, et al., "Multichannel Coding of Applause Signals," EURASIP Journal on Advances in Signal Processing, vol. 2008, Article ID 31693, Jul. 2007, 11 pages.

Breebaart, et al., "Parametric Coding of Stereo Audio," EURASIP Journal on Applied Signal Processing, Jan. 2005, 18 pages.

Faller, "Parametric Multichannel Audio Coding: Synthesis of Coherence Cues," IEEE Transactions on Speech and Audio Processing, vol. 16, Issue 1, Jan. 2006, 12 pages.

Foreign Communication From a Counterpart Application, PCT Application PCT/CN2010/075308, International Search Report dated Apr. 28, 2011, 5 pages.

Foreign Communication From a Counterpart Application, PCT Application PCT/CN2010/075308, Written Opinion dated Apr. 28, 2011, 10 pages.

Communication from a foreign counterpart application, International Application No. PCT/CN2010/075308, English Translation, International Search Report dated Apr. 28, 2011, 4 pages.

Foreign Communication From a Counterpart Application, Japanese Application No. 2013-519930, Japanese Office Action dated Feb. 4, 2014, 2 pages.

Foreign Communication From a Counterpart Application, Japanese Application No. 2013-519930, English Translation of Japanese Office Action dated Feb. 4, 2014, 2 pages.

Foreign Communication From a Counterpart Application, European Application No. 10854881.9, Extended European Search Report dated Feb. 5, 2015, 7 pages.

* cited by examiner

AUDIO SIGNAL SYNTHESIZER

CROSS-REFERENCE TO RELATED APPLICATION

This application is a continuation of International Application No. PCT/CN2010/075308, filed on Jul. 20, 2010, which is hereby incorporated by reference in its entirety.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to audio coding.

BACKGROUND

Parametric stereo or multi-channel audio coding as described e.g. in C. Faller and F. Baumgarte, "Efficient representation of spatial audio using perceptual parametrization," in Proc. IEEE Workshop on Appl. of Sig. Proc. to Audio and Acoust., October 2001, pp. 199-202, uses spatial cues to synthesize down-mix—usually mono or stereo—audio signals to signals with more channels. Usually, the down-mix audio signals result from a superposition of a plurality of audio channel signals of a multi-channel audio signal, e.g. of a stereo audio signal. These less channels are waveform coded and side information, i.e. the spatial cues, relating to the original signal channel relations is added to the coded audio channels. The decoder uses this side information to re-generate the original number of audio channels based on the decoded waveform coded audio channels.

A basic parametric stereo coder may use inter-channel level differences (ILD) as a cue needed for generating the stereo signal from the mono down-mix audio signal. More sophisticated coders may also use the inter-channel coherence (ICC), which may represent a degree of similarity between the audio channel signals, i.e. audio channels. Furthermore, when coding binaural stereo signals e.g. for 3D audio or headphone based surround rendering, also an inter-channel phase difference (IPD) may play a role to reproduce phase/delay differences between the channels.

The synthesis of ICC cues may be relevant for most audio and music contents to re-generate ambience, stereo reverb, source width, and other perceptions related to spatial impression as described in J. Blauert, Spatial Hearing: The Psychophysics of Human Sound Localization, The MIT Press, Cambridge, Mass., USA, 1997. Coherence synthesis may be implemented by using de-correlators in frequency domain as described in E. Schuijers, W. Oomen, B. den Brinker, and J. Breebaart, "Advances in parametric coding for high-quality audio," in Preprint 114th Conv. Aud. Eng. Soc., March 2003. However, the known synthesis approaches for synthesizing multi-channel audio signals may suffer from an increased complexity.

SUMMARY

A goal to be achieved by the present invention is to provide an efficient concept for synthesizing a multi-channel audio signal from a down-mix audio signal.

The invention is based on the finding, that a multi-channel audio signal may efficiently be synthesized from a down-mix audio signal upon the basis of at least three signal copies of the down-mix audio signal. The down-mix audio signal may comprise e.g. a sum of a left audio channel signal and a right audio channel signal of a multi-channel audio signal, e.g. of a stereo audio signal. Thus, a first copy may represent a first audio channel, a second copy may represent a diffuse sound and a third copy may represent a second audio channel. In order to synthesize, e.g. generate, the multi-channel audio signal, the second copy may be used to generate two de-correlated signals which may respectively be combined with the respective audio channel in order to synthesize the multi-channel audio signal. In order to obtain the two de-correlated signals, the second copy may be pre-stored or delayed in particular in frequency domain. However, the de-correlated signals may be obtained directly in time domain. In both cases, a low complexity arrangement may be achieved.

According to a first implementation form, the invention relates to an audio signal synthesizer for synthesizing a multi-channel audio signal from a down-mix audio signal, the audio signal synthesizer comprising a transformer for transforming the down-mix audio signal into frequency domain to obtain a transformed audio signal, the transformed audio signal representing a spectrum of the down-mix audio signal, a signal generator for generating a first auxiliary signal, for generating a second auxiliary signal, and for generating a third auxiliary signal upon the basis of the transformed audio signal, a de-correlator for generating a first de-correlated signal, and for generating a second de-correlated signal from the third auxiliary signal, the first de-correlated signal and the second de-correlated signal being at least partly de-correlated, and a combiner for combining the first auxiliary signal with the first de-correlated signal to obtain a first audio signal, and for combining the second auxiliary signal with the second de-correlated signal to obtain the second audio signal, the first audio signal and the second audio signal forming the multi-channel audio signal. The transformer may be a Fourier transformer or a filter bank for providing e.g. a short-time spectral representation of the down-mix audio signal. In this regard, the de-correlated signals may be regarded as being de-correlated if a first cross-correlation value of a cross-correlation between these signals is less than another cross-correlation value of the cross-correlation.

According to an implementation form of the first aspect, the transformer comprises a Fourier transformer or a filter to transform the down-mix audio signal into frequency domain. The Fourier transformer may be e.g. a fast Fourier transformer.

According to an implementation form of the first aspect, the transformed audio signal occupies a frequency band, wherein the first auxiliary signal, the second auxiliary signal and the third auxiliary signal share the same frequency sub-band of the frequency band. Correspondingly, the other sub-bands of the frequency band may correspondingly be processed.

According to an implementation form of the first aspect, the signal generator comprises a signal copier for providing signal copies of the transformed audio signal, a first multiplier for multiplying a first signal copy by a first weighting factor for obtaining a first weighted signal, a second multiplier for multiplying a second signal copy by a second weighting factor for obtaining a second weighted signal, and a third multiplier for multiplying a third signal copy by a third weighting factor for obtaining a third weighted signal, and wherein the signal generator is configured to generate the auxiliary signals upon the basis of the weighted signals. The weighting factors may be used to adjust or scale the power of the respective signal copy to the respective first audio channel, second audio channel and the diffuse sound.

According to an implementation form of the first aspect, the audio signal synthesizer comprises a transformer for transforming the first weighted signal into time domain to obtain the first auxiliary signal, for transforming the second weighted signal into time domain to obtain the second auxiliary signal, and for transforming the third weighted signal into time domain to obtain the third auxiliary signal. The transformer may be e.g. an inverse Fourier transformer.

According to an implementation form of the first aspect, the first weighting factor depends on a power of a right audio channel of the multi-channel audio signal, and wherein the second weighting factor depends on a power of a left audio channel of the multi-channel audio signal. Thus, the power of both audio channels may respectively be adjusted.

According to an implementation form of the first aspect, the de-correlator comprises a first storage for storing a first copy of the third auxiliary signal in frequency domain to obtain the first de-correlated signal, and a second storage for storing a second copy of the third auxiliary signal in frequency domain to obtain the second de-correlated signal. The first storage and the second storage may be configured for storing the copy signals for different time periods in order to obtain de-correlated signals.

According to an implementation form of the first aspect, the de-correlator comprises a first delay element for delaying a first copy of the third auxiliary signal to obtain the first de-correlated signal, and a second delay element for delaying a second copy of the third auxiliary signal to obtain the second de-correlated signal. The delay elements may be arranged in time domain or in frequency domain.

According to an implementation form of the first aspect, the de-correlator comprises a first all-pass filter for filtering a first copy of the third auxiliary signal to obtain the first de-correlated signal, and a second all-pass filter for filtering a second copy of the third auxiliary signal to obtain the second de-correlated signal. Each all-pass filter may be formed by an all-pass network, by way of example.

According to an implementation form of the first aspect, the de-correlator comprises a first reverberator for reverberating a first copy of the third auxiliary signal to obtain the first de-correlated signal, and a second reverberator for reverberating a second copy of the third auxiliary signal to obtain the second de-correlated signal.

According to an implementation form of the first aspect, the combiner is configured to add up the first auxiliary signal and the first de-correlated signal to obtain the first audio signal, and to add up the second auxiliary signal and the second de-correlated signal to obtain the second audio signal. Thus, the combiner may comprise adders for adding up the respective signals.

According to an implementation form of the first aspect, the audio signal synthesizer further comprises a transformer for transforming the first audio signal and the second audio signal into time domain. The transformer may be e.g. an inverse Fourier transformer.

According to an implementation form of the first aspect, the first audio signal represents a left channel of the multi-channel audio signal, wherein the second audio signal represents a right channel of the multi-channel audio signal, and wherein the de-correlated signals represent a diffuse audio signal. The diffuse audio signal may represent a diffuse sound.

According to an implementation form of the first aspect, the audio signal synthesizer further comprises an energy determiner for determining an energy of the first de-correlated signal and an energy of the second de-correlated signal, a first energy normalizer for normalizing the energy of the first de-correlated signal, and a second energy normalizer for normalizing the energy of the second de-correlated signal.

According to a second aspect, the invention relates to a method for synthesizing, e.g. for generating, a multi-channel audio signal, e.g. a stereo audio signal, from a down-mix audio signal, the method comprising transforming the down-mix audio signal into frequency domain to obtain a transformed audio signal, the transformed audio signal representing a spectrum of the down-mix audio signal, generating a first auxiliary signal, a second auxiliary signal and a third auxiliary signal upon the basis of the transformed audio signal, generating a first de-correlated signal from the third auxiliary signal, and generating a second de-correlated signal from the third auxiliary signal, the first de-correlated signal and the second de-correlated signal being at least partly de-correlated, and combining the first auxiliary signal with the first de-correlated signal to obtain a first audio signal, and combining the second auxiliary signal with the second de-correlated signal to obtain the second channel signal, the first audio signal and the second audio signal forming the multi-channel audio signal.

According to some embodiments, a method for generating a multi-channel audio signal from a down-mix signal may comprise the steps of: receiving a down-mix signal, converting the input down-mix audio signal to a plurality of sub-bands, applying factors in the subband domain to generate subband signals representing correlated and un-correlated signal of a target multi-channel signal, converting the generated subband signals to the time-domain, de-correlating the generated time-domain signals representing un-correlated signal, and combining the time-domain signals representing correlated signal with the de-correlated signals.

According to a fourth aspect, the invention relates to a computer program for performing the method for synthesizing a multi-channel audio signal when executed on a computer.

BRIEF DESCRIPTION OF THE DRAWINGS

Further embodiments of the invention will be described with respect to the following figures, in which.

DETAILED DESCRIPTION

Figure 1:
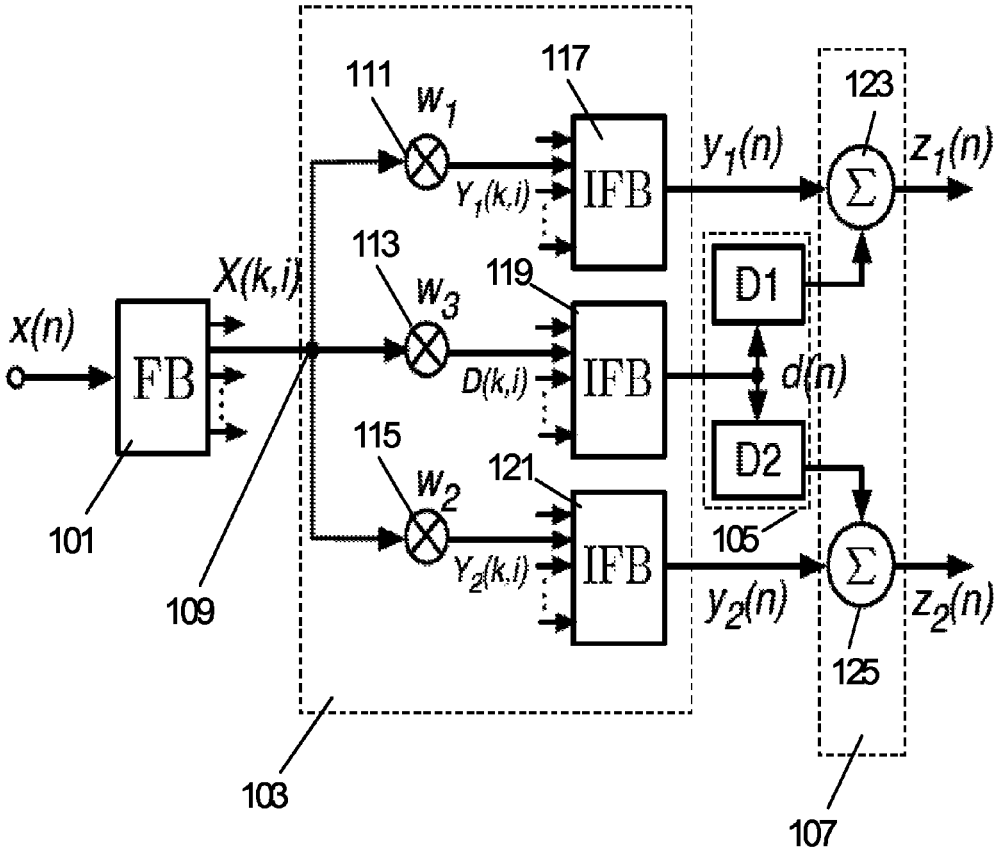
FIG. 1 shows a block diagram of an audio signal synthesizer according to an embodiment.

FIG. 1 shows a block diagram of an audio signal synthesizer comprising a transformer 101 for transforming a down-mix audio signal, x(n) into a frequency domain to obtain a transformed audio signal, X(k,i) which represents a spectrum of the down-mix audio signal. The audio signal synthesizer further comprises a signal generator 103 for generating a first auxiliary signal $y_1(n)$, for generating a second auxiliary signal $y_2(n)$ and for generating a third auxiliary signal d(n) upon the basis of the transformed audio signal. The audio signal synthesizer further comprises a de-correlator 105 for generating a first de-correlated signal and a second de-correlated signal from the third auxiliary signal d(n). The audio signal synthesizer further comprises a combiner 107 for combining the first auxiliary signal with the first de-correlated signal to obtain a first audio signal, $z_1(n)$, and for combining the second auxiliary signal with the second de-correlated signal to obtain the second audio signal which may respectively form the left audio channel and the right audio channel of a stereo audio signal.

The transformer 101 may be e.g. a Fourier transformer or any filter bank (FB) which is configured to provide a short time spectrum of the down-mix signal. The down-mix signal may be generated upon the basis of combining a left channel and a right channel of e.g. a recorded stereo signal, by way of example.

The signal generator 103 may comprise a signal copier 109 providing e.g. three copies of the transformed audio signal. For each copy, the audio signal synthesizer may comprise a multiplier. Thus, the signal generator 103 may comprise a first multiplier 111 for multiplying a first copy by a first weighting factor $w_1$, a second multiplier 113 for multiplying a second copy by a second weighting factor $w_3$, and a third multiplier 115 for multiplying a third copy by a weighting factor $w_2$.

According to some embodiments, the multiplied copies form weighted signals $Y_1(k, i)$, $D(k, i)$ and $Y_2(k, i)$ which may respectively be provided to the inverse transformers 117, 119 and 121. The inverse transformers 117 to 121 may e.g. be formed by inverse filter banks (IFB) or by inverse Fourier transformers. At the outputs of the inverse transformers 117 to 121, the first, second and third auxiliary signals may be provided. In particular, the third auxiliary signal at the output of the inverse transformer 119 is provided to the de-correlator 105 comprising a first de-correlating element D1 and a second de-correlating element D2. The de-correlating elements D1 and D2 may be formed e.g. by delay elements or by reverberation elements or by all-pass filters. By way of example, the de-correlating elements may delay copies of the third auxiliary signal with respect to each other so that a de-correlation may be achieved. The respective de-correlated signals are provided to the combiner 107 which may comprise a first adder 123 for adding a first de-correlated signal to the first auxiliary signal to obtain the first audio signal, and a second adder 125 for adding the second de-correlated signal to the second auxiliary signal to obtain the second audio signal.

As depicted in FIG. 1, the de-correlation may be performed in time domain. Correspondingly, the de-correlated signals and the respective auxiliary signals may be superimposed in time domain. However, the de-correlation and the superimposition may be performed in frequency domain, as depicted in FIG. 2.

Figure 2:
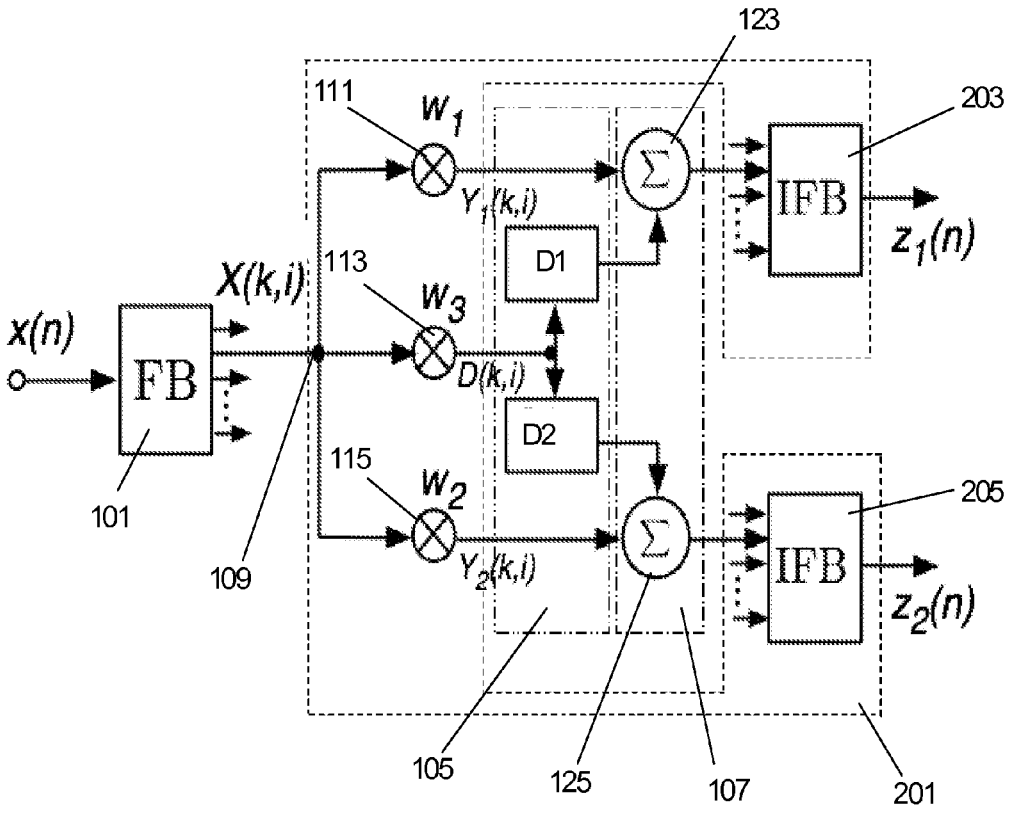
FIG. 2 shows an audio signal synthesizer according to an embodiment.

FIG. 2 shows an audio signal synthesizer having a structure which differs from the structure of the audio signal synthesizer shown in FIG. 1. In particular, the audio signal synthesizer of FIG. 2 comprises a signal generator 201 which operates in frequency domain. In particular, the signal generator 201 comprises the de-correlator 105 which is arranged in frequency domain to de-correlate the output of the second multiplier 113 using the de-correlating elements D1 and D2. In the embodiment shown in FIG. 2, the output signals of the multipliers 111, 113 and 115 respectively form the first, second and third auxiliary signal according to some embodiments. The de-correlating elements D1 and D2 may be formed by delay elements or by storages respectively storing a copy of the third auxiliary signal in frequency domain for a predetermined, different period of time. The outputs of the de-correlating elements D1 and D2 are respectively provided to the combiner 107 with the adders 123 and 125 which are arranged in frequency domain. The outputs of the adders 123 and 125 are respectively provided to the inverse transformers 203 and 205 which may be implemented by inverse Fourier transformers or inverse filter banks to respectively provide time-domain signals $z_1(n)$ and $z_2(n)$.

With reference to FIGS. 1 and 2, the down-mix audio signal may be a time signal which is denoted x(n), where n is the discrete time index. The corresponding time-frequency representation of this signal is X (k,i), where k is the e.g. down-sampled time index and i is the parameter frequency band index. Without loss of generality, an example using inter-channel level difference (ICLD) and ICC synthesis may be considered. As shown e.g. in FIG. 1, the mono down-mix audio signal x(n) is converted to e.g. a short-time spectral representation by a FB or transformer. By way of example, the processing for one parametric stereo parameter band is shown in detail in FIGS. 1 and 2. All other bands may be processed similarly. The scale factors w1, w2, and w3 representing the weighting factors are applied to the time-frequency representation of the down-mix signal, X(k,i), to generate the time-frequency representations of the left correlated sound, $Y_1(k,i)$ forming an embodiment of a first auxiliary signal, a right correlated sound, $Y_2(k,i)$, forming an embodiment of a second auxiliary signal, and left-right un-correlated sound, D(k,i), forming an embodiment of a third auxiliary signal, respectively.

The generated time-frequency representation of the three signals, $Y_1(k,i)$, $Y_2(k,i)$, and D(k,i), are converted back to the time domain by using an IFB or an inverse transformer. By way of example, two independent de-correlators $D_1$ and $D_2$ are applied to d(n) in order to generate two at least partly independent signals, which are added to $y_1(n)$ and $y_2(n)$ to generate e.g. the final stereo output left and right signals, i.e. first and second audio signals, $z_1(n)$ and $z_2(n)$.

With reference to generating or computing the weighting factors, if an amplitude of the downmix signal is $|M|=g\sqrt{|L|^2+|R|^2}$, L and denoting the amplitudes of the left, L, and right, R, channel, then, at the decoder, the relative power of the left and right channels are known according to the following formulas based on the ICLD:

$$P_1(k, i) = \frac{1}{1 + 10^{\frac{ICLD}{10}}}$$

$$P_2(k, i) = \frac{10^{\frac{ICLD}{10}}}{1 + 10^{\frac{ICLD}{10}}}$$

It shall be noted that in the following, for brevity of notation, the indices k and i are often neglected.

Given the ICC (coherence) the amount of diffuse sound in the left and right channels, $P_D(k,i)$, can be computed according to the formula:

$$P_D = \frac{P_1 + P_2 - \sqrt{(P_1 + P_2)^2 - 4(1 - ICC^2)P_1 P_2}}{2}$$

Before using further, $P_D$ may be lower bounded by zero and upper bounded by the minimum of $P_1$ and $P_2$.

The weighting factors are computed such that the resulting three signals $Y_1$, $Y_2$, and D may have powers equal to $P_1$, $P_2$, and $P_D$, i.e.:

$$w1 = \sqrt{\frac{P_1 - P_D}{g^2 P}}$$

$$w2 = \sqrt{\frac{P_2 - P_D}{g^2 P}}$$

$$w3 = \sqrt{\frac{P_D}{g^2 P}}$$

where the power of the down-mix audio signal is P=1 since $P_1$, $P_2$, and $P_D$ may be normalized, and the factor of g relates to the normalization that is used for the down-mix input signal. In the conventional case, when the down-mix signal may be the sum multiplied by 0.5, and g may be chosen to be 0.5.

If the amplitude of the downmix signal is $$|M| = \frac{|L| + |R|}{2},$$

then some adaptations may be made. The channel level differences (CLDs) may be applied to the downmix at the decoder side using the following formulas for c1 and c2:

$$c = 10^{\frac{CLD}{20}} = \frac{|L|}{|R|}$$

$$c_1 = \frac{2c}{1+c} = \frac{2|L|}{|L| + |R|}$$

$$c_2 = \frac{2}{1+c} = \frac{2|R|}{|L| + |R|}$$

The definitions for $c_1$ and $c_2$ may allow recovering the correct amplitude for the left and the right channel.

$P_1$ and $P_2$ may be defined according to the previous definition as:

$$P_1(k, i) = \frac{1}{1 + 10^{\frac{CLD}{10}}} \text{ and}$$

$$P_2(k, i) = \frac{10^{\frac{ICLD}{10}}}{1 + 10^{\frac{ICLD}{10}}}$$

leading to $$P_1(k, i) = \frac{|R|^2}{|L|^2 + |R|^2}$$

and $$P_2(k, i) = \frac{|L|^2}{|L|^2 + |R|^2}$$

Then $P_D$ may be defined based on the above $P_1$ and $P_2$ as aforementioned.

If a case is considered where ICC=1, and if the amplitude of the downmix signal is assumed to be $$|M| = \frac{|L| + |R|}{2},$$

then the definition of $P_1$, $P_2$ and $P_D$ may be used and applied on the downmix signal, yielding:

$$|\hat{R}| = w_1|M| = \sqrt{\frac{P_1}{g^2}}\,|M|$$

$$|\hat{R}| = 2\sqrt{\frac{|R|^2}{|L|^2 + |R|^2}}\,|M|$$

$$= 2\sqrt{\frac{|R|^2}{|L|^2 + |R|^2}}\,\frac{|L| + |R|}{2}$$

$$= |R|\sqrt{\frac{(|L| + |R|)^2}{|L|^2 + |R|^2}}$$

To cancel the effect of the mismatch between downmix computation and the assumption on $P_1$ and $P_2$ factors, some adaptations of the above formulas may be performed. Assuming:

$$c = 10^{\frac{CLD}{20}} = \frac{|L|}{|R|}$$

and $$d = 10^{\frac{CLD}{10}} = \frac{|L|^2}{|R|^2}$$

yields $$\frac{1}{1+d} = \frac{|R|^2}{|L|^2 + |R|^2}$$

$$\frac{1}{(1+c)^2} = \frac{|R|^2}{(|L| + |R|)^2}$$

with $$\text{factor} = \frac{1+d}{(1+c)^2} = \frac{|L|^2 + |R|^2}{(|L| + |R|)^2}$$

For the downmix signal defined as $$|M| = \frac{|L| + |R|}{2},$$

the w1, w2 and w3 may be adapted to keep the energy of the left and right channel according to:

$$w_1 = 2\sqrt{(P_1 - P_d)*\text{factor}}$$

$$w_2 = 2\sqrt{(P_2 - P_d)*\text{factor}}$$

$$w_3 = 2\sqrt{(P_d)*\text{factor}}$$

In the case ICC=1, the definitions of w1, w2 and w3 allow to obtain exactly the same result as with the weighting factor $c_1$ and $c_2$.

Another alternative adaptation method is described in the following:

In a stereo coder based on CLD, there are two gains for left and right channel, respectively. The gains may be multiplied to the decoded mono signal to generate the reconstructed left and right channel.

The gains may thus be calculated according to the following equations:

$$c = 10^{\frac{CLD}{20}}$$

$$c_1 = \frac{2c}{1+c}$$

$$c_2 = \frac{2}{1+c}.$$

These gain factors may be used to compute:

$$P_1 = c_1^2$$

$$P_2 = c_2^2$$

$$P = P_1 + P_2$$

These $P_1$, $P_2$ and P may further be used to calculate the w1, w2 and w3 as aforementioned. The factors w1, w2 and w3 may be scaled by $$f = \frac{\sqrt{P}}{\sqrt{w_1^2 + w_2^2 + w_3^2}}$$

and then applied to the left, right and diffuse signal, respectively.

Alternatively, as opposed to computing the signals $Y_1$, $Y_2$, and D to have a power of $P_1$, $P_2$, and $P_D$, respectively, a Wiener filter may be applied to approximate the true signals $Y_1$, $Y_2$, and D in a least mean squares sense. In this case, the Wiener filter coefficients are:

$$w1 = \frac{P_1 - P_D}{g^2 P}$$

$$w2 = \frac{P_2 - P_D}{g^2 P}$$

$$w3 = \frac{P_D}{g^2 P}$$

Regarding the de-correlators, the diffuse signal in the time domain before de-correlation, d(n), has the short-time power spectra desired for the diffuse sound, due to the way how the scale factors w1, w2, and w3 were computed. Thus, the goal is to generate two signals $d_1(n)$ and $d_2(n)$ from d(n) using de-correlators without changing the signal power and short-time power spectra more than necessary.

For this purpose, two orthogonal filters $D_1$ and $D_2$ with unity $L_2$ norm may be used. Alternatively one may use orthogonal all-pass filters or reverberators in general. For example, two orthogonal finite impulse response (FIR) filters, suitable for de-correlation are:

$$D_1(n) = w(n)n1(n)$$

$$D_2(n) = w(n)n2(n)$$

where n1(*n*) is a random variable, such as a white Gaussian noise for indices $0 \le n \le M$ and otherwise zero. n2(*n*) is similarly defined as random variable independent of n1(*n*). The window w(n) can for example be chosen to be a Hann window with an amplitude such that the $L_2$ norm of the filters $D_1(n)$ and $D_2(n)$ is one.

Figure 3:
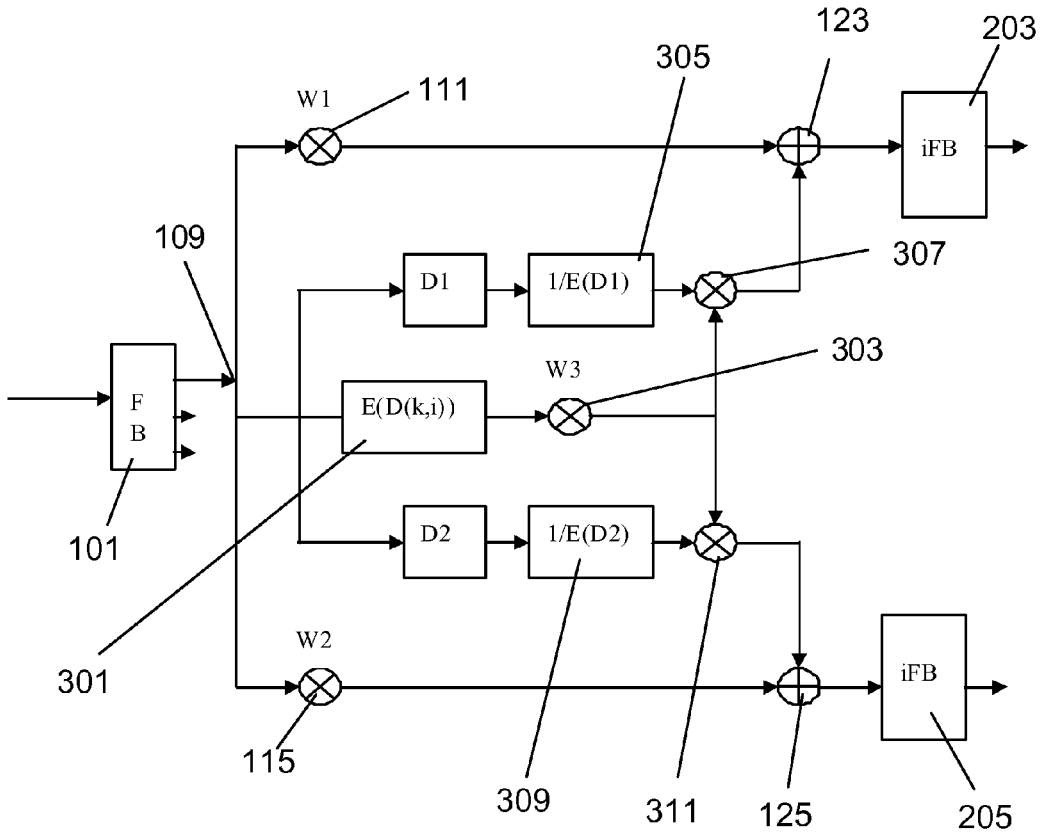
FIG. 3 shows an audio signal synthesizer according to an embodiment.

FIG. 3 shows an audio signal synthesizer having a structure similar to that of the audio signal synthesizer shown in FIG. 2. A first auxiliary signal provided by the filter bank 101 is provided to the multiplier 111, a second auxiliary signal provided by the filter bank 101 is provided to the multiplier 115, and a first copy of the third auxiliary signal is provided to an energy determiner 301 which determines the energy of auxiliary signals D(k, i) after the delay elements D1 and D2. An output of the energy determiner 301 is provided to a multiplier 303 multiplying the output of the energy determiner 301 by the factor w3 and providing the multiplied value to the multiplier 123.

A second copy of the third auxiliary signal is provided to the first delay element D1 which output is provided to a first energy normalizer 305 normalizing an output of the first delay element D1 e.g. with respect to its energy E(D1). An output of the first energy normalizer 305 is multiplied with the output of the multiplier 303 by a multiplier 307, which output is provided to the adder 123.

A third copy of the third auxiliary signal is provided to the second delay element D2 which output is provided to a second energy normalizer 309 normalizing an output of the second delay element D2 e.g. with respect to its energy E(D2). An output of the second energy normalizer 309 is multiplied with the output of the multiplier 303 by a multiplier 311, which output is provided to the adder 125.

In FIG. 3, an alternative solution of the algorithm to apply the weighting functions w1, w2 and w3 is depicted. The weighting functions w1, w2 and w3 may be defined in order to keep the energy of original left and right channels. According to an embodiment, the w3 is applied on the delayed signal after the energy normalization. In the previous embodiment shown in FIG. 2, the w3 may directly be applied on the downmix signal. Then, the delayed versions may used to create the decorrelated part of the stereo signal using the delays D1 and D2. Due to the delays D1 and D2, the decorrelated part added to $Y_1(k,i)$ and $Y_2(k,i)$ may be multiplied by a gain w3 computed at a previous frame.

Still in reference to FIG. 3, in a first step, the energy of the signal E(D(k, i)) after the delays D(k,i) may be calculated. In a second step, the output of the delays may be normalised using the calculated energies E(D1) and E(D2). In a third step, the normalized D1 and D2 signals are multiplied by w3. In a fourth step, the energy adjusted versions of D1 and D2 may be added to the signals Y1(*k,i*) and Y2(*k,i*) at the adders 123 and 125.

A low complexity way of doing de-correlation is simply using different delays for $D_1$ and $D_2$. This approach may exploit the fact that the signal representing de-correlated sound d(n) contains little transients. By way of example, the delays of 10 milliseconds (ms) and 20 ms for $D_1$ and $D_2$ may be used.

What is claimed is:

1. Audio signal synthesizer for synthesizing a multi-channel audio signal from a down-mix audio signal, the audio signal synthesizer comprising:

a transformer configured to transform the down-mix audio signal into frequency domain to obtain a transformed audio signal, wherein the transformed audio signal represents a spectrum of the down-mix audio signal;

a signal generator configured to generate a first auxiliary signal, a second auxiliary signal, and a third auxiliary signal upon the basis of the transformed audio signal;

a de-correlator configured to generate a first de-correlated signal and a second de-correlated signal from the third auxiliary signal, wherein the first de-correlated signal and the second de-correlated signal are at least partly de-correlated; and a combiner configured to combine the first auxiliary signal with the first de-correlated signal to obtain a first audio signal, and for combining the second auxiliary signal with the second de-correlated signal to obtain the second audio signal, wherein the first audio signal and the second audio signal form the multi-channel audio signal, wherein the de-correlator comprises:

a first delay element configured to delay a first copy of the third auxiliary signal to obtain the first de-correlated signal; and a second delay element configured to delay a second copy of the third auxiliary signal to obtain the second de-correlated signal.

2. The audio signal synthesizer of claim 1, wherein the transformer comprises a Fourier transformer or a filter to transform the down-mix audio signal into the frequency domain.

3. The audio signal synthesizer of claim 1, wherein the transformed audio signal occupies a frequency band, and wherein the first auxiliary signal, the second auxiliary signal and the third auxiliary signal share a same frequency sub-band of the frequency band.

4. The audio signal synthesizer of claim 1, wherein the de-correlator comprises:

a first storage configured to store a first copy of the third auxiliary signal in frequency domain to obtain the first de-correlated signal; and a second storage configured to store a second copy of the third auxiliary signal in frequency domain to obtain the second de-correlated signal.

5. The audio signal synthesizer of claim 1, wherein the de-correlator comprises:

a first all-pass filter configured to filter a first copy of the third auxiliary signal to obtain the first de-correlated signal; and a second all pass-filter configured to filter a second copy of the third auxiliary signal to obtain the second de-correlated signal.

6. The audio signal synthesizer of claim 1, wherein the de-correlator comprises:

a first reverberator configured to reverberate a first copy of the third auxiliary signal to obtain the first de-correlated signal; and a second reverberator configured to reverberate a second copy of the third auxiliary signal to obtain the second de-correlated signal.

7. The audio signal synthesizer of claim 1, wherein the combiner is configured to add up the first auxiliary signal and the first de-correlated signal to obtain the first audio signal, and to add up the second auxiliary signal and the second de-correlated signal to obtain the second audio signal.

8. The audio signal synthesizer of claim 1, the signal generator comprising a transformer configured to transform the first audio signal and the second audio signal into time domain.

9. The audio signal synthesizer of claim 1, wherein the first audio signal represents a left channel of the multi-channel audio signal, wherein the second audio signal represents a right channel of the multi-channel audio signal, and wherein the de-correlated signals represent a diffuse audio signal.

10. The audio signal synthesizer of claim 1, further comprising:

an energy determiner configured to determine an energy of the first de-correlated signal and an energy of the second de-correlated signal;

a first energy normalizer configured to normalize the energy of the first de-correlated signal; and a second energy normalizer configured to normalize the energy of the second de-correlated signal.

11. Audio signal synthesizer for synthesizing a multi-channel audio signal from a down-mix audio signal, the audio signal synthesizer comprising:

a transformer configured to transform the down-mix audio signal into frequency domain to obtain a transformed audio signal, wherein the transformed audio signal represents a spectrum of the down-mix audio signal;

a signal generator configured to generate a first auxiliary signal, a second auxiliary signal, and a third auxiliary signal upon the basis of the transformed audio signal;

a de-correlator configured to generate a first de-correlated signal and a second de-correlated signal from the third auxiliary signal, wherein the first de-correlated signal and the second de-correlated signal are at least partly de-correlated; and a combiner configured to combine the first auxiliary signal with the first de-correlated signal to obtain a first audio signal, and for combining the second auxiliary signal with the second de-correlated signal to obtain the second audio signal, wherein the first audio signal and the second audio signal form the multi-channel audio signal, wherein the signal generator comprises:

a signal copier configured to provide signal copies of the transformed audio signal;

a first multiplier configured to multiply a first signal copy by a first weighting factor for obtaining a first weighted signal;

a second multiplier configured to multiply a second signal copy by a second weighting factor for obtaining a second weighted signal; and a third multiplier configured to multiply a third signal copy by a third weighting factor for obtaining a third weighted signal, and wherein the signal generator is configured to generate the auxiliary signals upon the basis of the weighted signal copies.

12. The audio signal synthesizer of claim 11, wherein the signal generator comprising a transformer configured to transform the first weighted signal into time domain to obtain the first auxiliary signal, transform the second weighted signal into the time domain to obtain the second auxiliary signal, and transform the third weighted signal into the time domain to obtain the third auxiliary signal.

13. The audio signal synthesizer of claim 12, wherein the first weighting factor depends on a power of a first audio channel of the multi-channel audio signal, and wherein the second weighting factor depends on a power of a second audio channel of the multi-channel audio signal.

14. A method for synthesizing a multi-channel audio signal from a down-mix audio signal, the method comprising:

transforming the down-mix audio signal into frequency domain to obtain a transformed audio signal, wherein the transformed audio signal represents a spectrum of the down-mix audio signal;

generating a first auxiliary signal, a second auxiliary signal and a third auxiliary signal upon the basis of the transformed audio signal;

generating a first de-correlated signal from the third auxiliary signal and generating a second de-correlated signal from the third auxiliary signal, wherein the first de-correlated signal and the second de-correlated signal are at least partly de-correlated; and combining the first auxiliary signal with the first de-correlated signal to obtain a first audio signal and combining the second auxiliary signal with the second de-correlated signal to obtain the second channel signal, wherein the first audio signal and the second audio signal form the multi-channel audio signal, wherein generating a first de-correlated signal from the third auxiliary signal and generating a second de-correlated signal from the third auxiliary signal comprises:

delaying a first copy of the third auxiliary signal to obtain the first de-correlated signal; and delaying a second copy of the third auxiliary signal to obtain the second de-correlated signal.

15. The method of claim 14, wherein the transformed audio signal occupies a frequency band, and wherein the first auxiliary signal, the second auxiliary signal and the third auxiliary signal share a same frequency sub-band of the frequency band.

16. The method of claim 14, wherein generating a second de-correlated signal from the third auxiliary signal comprises:

storing a first copy of the third auxiliary signal in the frequency domain to obtain the first de-correlated signal; and storing a second copy of the third auxiliary signal in the frequency domain to obtain the second de-correlated signal.

17. The method of claim 14, wherein generating a second de-correlated signal from the third auxiliary signal comprises:

filtering a first copy of the third auxiliary signal to obtain the first de-correlated signal; and filtering a second copy of the third auxiliary signal to obtain the second de-correlated signal.

18. The method of claim 14, wherein generating a second de-correlated signal from the third auxiliary signal comprises:

reverberating a first copy of the third auxiliary signal to obtain the first de-correlated signal; and reverberating a second copy of the third auxiliary signal to obtain the second de-correlated signal.

19. The method of claim 14, wherein combining the first auxiliary signal with the first de-correlated signal to obtain a first audio signal and combining the second auxiliary signal with the second de-correlated signal to obtain the second channel signal comprises:

adding up the first auxiliary signal and the first de-correlated signal to obtain the first audio signal; and adding up the second auxiliary signal and the second de-correlated signal to obtain the second audio signal.

20. The method of claim 14, wherein the first audio signal represents a left channel of the multi-channel audio signal, wherein the second audio signal represents a right channel of the multi-channel audio signal, and wherein the de-correlated signals represent a diffuse audio signal.

21. The method of claim 14, further comprising:

determining an energy of the first de-correlated signal and an energy of the second de-correlated signal;

normalizing the energy of the first de-correlated signal; and normalizing the energy of the second de-correlated signal.

22. A method for synthesizing a multi-channel audio signal from a down-mix audio signal, the method comprising:

transforming the down-mix audio signal into frequency domain to obtain a transformed audio signal, wherein the transformed audio signal represents a spectrum of the down-mix audio signal;

generating a first auxiliary signal, a second auxiliary signal and a third auxiliary signal upon the basis of the transformed audio signal;

generating a first de-correlated signal from the third auxiliary signal and generating a second de-correlated signal from the third auxiliary signal, wherein the first de-correlated signal and the second de-correlated signal are at least partly de-correlated; and combining the first auxiliary signal with the first de-correlated signal to obtain a first audio signal and combining the second auxiliary signal with the second de-correlated signal to obtain the second channel signal, wherein the first audio signal and the second audio signal form the multi-channel audio signal, wherein generating a first auxiliary signal, a second auxiliary signal and a third auxiliary signal upon the basis of the transformed audio signal comprises:

providing signal copies of the transformed audio signal;

multiplying a first signal copy by a first weighting factor to obtain a first weighted signal;

multiplying a second signal copy by a second weighting factor to obtain a second weighted signal;

multiplying a third signal copy by a third weighting factor to obtain a third weighted signal; and generating the auxiliary signals upon the basis of the weighted signal copies.

23. The method of claim 22, wherein generating the auxiliary signals upon the basis of the weighted signal copies comprises:

transforming the first weighted signal into time domain to obtain the first auxiliary signal;

transforming the second weighted signal into the time domain to obtain the second auxiliary signal; and transforming the third weighted signal into the time domain to obtain the third auxiliary signal.

24. The method of claim 23, wherein the first weighting factor depends on a power of a first audio channel of the multi-channel audio signal, and wherein the second weighting factor depends on a power of a second audio channel of the multi-channel audio signal.

25. A non-transitory computer readable storage medium comprising computer program codes which when executed by a computer processor cause the computer processor to execute the steps of:

transforming a down-mix audio signal into frequency domain to obtain a transformed audio signal, wherein the transformed audio signal represents a spectrum of the down-mix audio signal;

generating a first auxiliary signal, a second auxiliary signal and a third auxiliary signal upon the basis of the transformed audio signal;

generating a first de-correlated signal from the third auxiliary signal and generating a second de-correlated signal from the third auxiliary signal, wherein the first de-correlated signal and the second de-correlated signal are at least partly de-correlated; and combining the first auxiliary signal with the first de-correlated signal to obtain a first audio signal and combining the second auxiliary signal with the second de-correlated signal to obtain the second channel signal, wherein the first audio signal and the second audio signal form the multi-channel audio signal, wherein generating a first de-correlated signal from the third auxiliary signal and generating a second de-correlated signal from the third auxiliary signal comprises:

delaying a first copy of the third auxiliary signal to obtain the first de-correlated signal; and delaying a second copy of the third auxiliary signal to obtain the second de-correlated signal.

* * * * *